US007004096B1

(12) United States Patent
Beal et al.

(10) Patent No.: US 7,004,096 B1
(45) Date of Patent: Feb. 28, 2006

(54) MARINE VESSEL COAMING STRUCTURE

(76) Inventors: Robert Wayne Beal, 9600 SW. Iowa Dr., Tualatin, OR (US) 97062; Thomas J Vincent, 1349 Westview Dr., Grants Pass, OR (US) 97527

( * ) Notice: Subject to any disclaimer, the term of this patent is extended or adjusted under 35 U.S.C. 154(b) by 0 days.

(21) Appl. No.: 10/844,911

(22) Filed: May 12, 2004

(51) Int. Cl.
*B63B 19/12* (2006.01)

(52) U.S. Cl. ..... 114/201 R

(58) Field of Classification Search ..... 114/201 R, 114/203, 117
See application file for complete search history.

(56) References Cited

U.S. PATENT DOCUMENTS 4,362,118 A * 12/1982 Koch et al. ..... 114/201 R
4,385,580 A * 5/1983 Davidson ..... 114/201 R
5,076,188 A * 12/1991 Burroughs ..... 114/201 R
5,848,575 A * 12/1998 Freeman et al. ..... 114/117

* cited by examiner

*Primary Examiner*—Stephen Avila
(74) *Attorney, Agent, or Firm*—Ingrid McTaggart

(57) ABSTRACT

One embodiment of a marine vessel includes a hull having an aperture therein and an exterior surface that defines a plane, and a coaming structure secured within the aperture of the hull, the coaming structure including a top surface that defines a plane contiguous with the plane of the hull, wherein the coaming structure is adapted for securing a closure structure thereon.

27 Claims, 8 Drawing Sheets

30
28
90
58
92
74
104
96
98
100
26
24
36
94
34
14
10
13
50
18
52
54
102
106
60
62

MARINE VESSEL COAMING STRUCTURE

BACKGROUND

Marine vessel hulls may include openings for securing windows and hatches therein. These openings may decrease the structural integrity of the hull and may be easily detectable by radar.

DETAILED DESCRIPTION OF THE DRAWINGS

Figure 1:
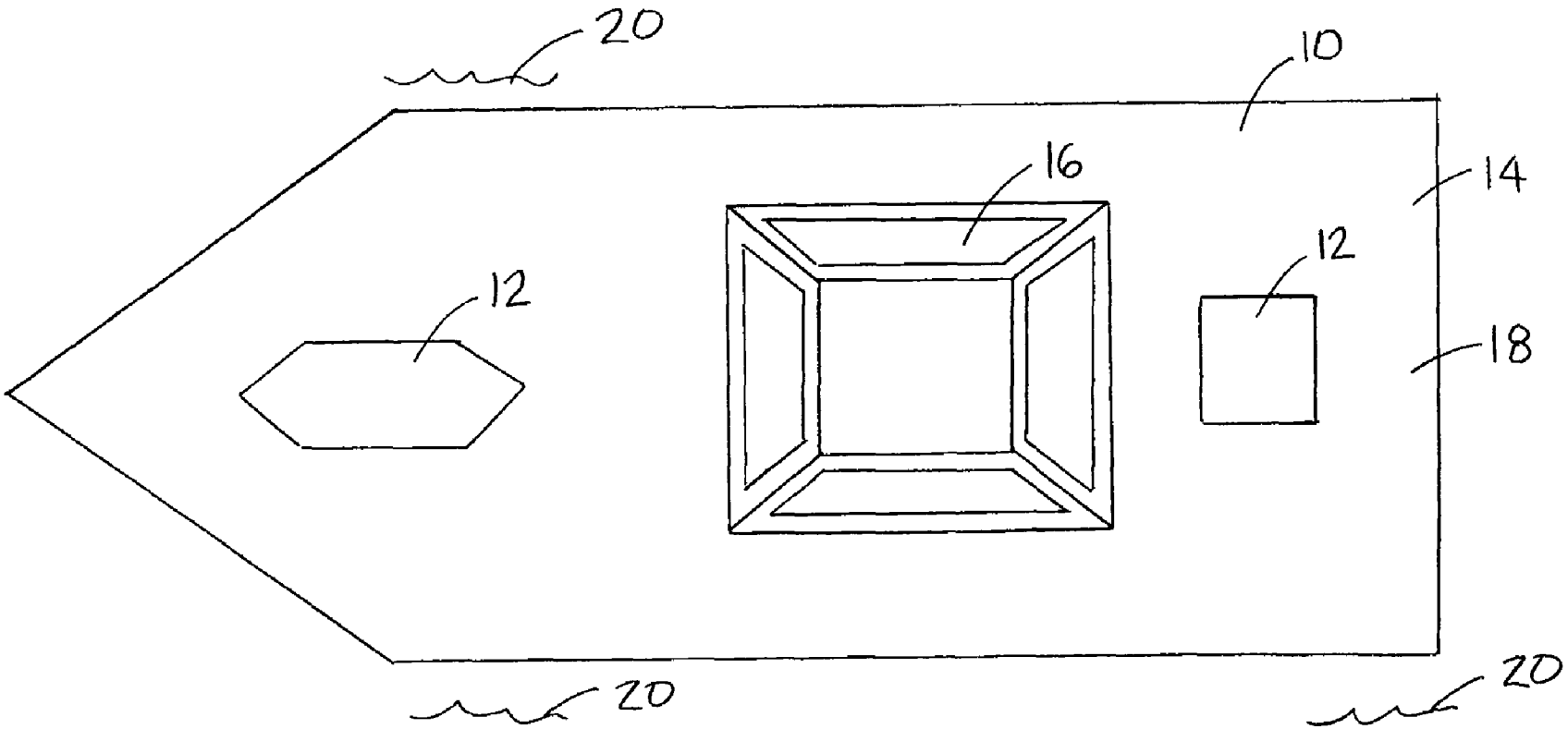
FIG. 1 is a top view of one embodiment of a marine vessel including one embodiment of a coaming structure securing two different embodiments of a closure structure thereto.

FIG. 1 is a top view of one embodiment of a marine vessel 10 including two embodiments of a closure structure 12, such as a hatch or a window. Vessel 10 may comprise any vessel adapted for use on or in water, such as a boat, a submarine, or a plane adapted for landing on water. In the embodiment shown, vessel 10 may comprise a boat including a hull 14, wherein hull 14 may comprise a portion of vessel 10 that may come into contact with a body of water through which vessel 10 moves. Vessel 10 may further include a control area 16 for crew members or control components. Hull 14 may include an exterior surface 18 that may be generally streamlined and/or have a smooth surface so as to cut through the water and/or air during movement of vessel 10 therethrough. Closure structure 12 may be positioned anywhere on hull 14 but generally may be positioned on a region of hull 14 that may come into contact with water 20 surrounding hull 14 so that closure structure 12 and a coaming structure (see FIG. 3) to which the closure structure is attached may define a water-tight seal. The coaming structure and the closure structure 12 may be positioned on a portion of hull 14 that may be walked on, so that it may be desirable that closure structure 12, and the coaming structure to which it is secured, may support the weight of a person without appreciably deforming.

Figure 2:
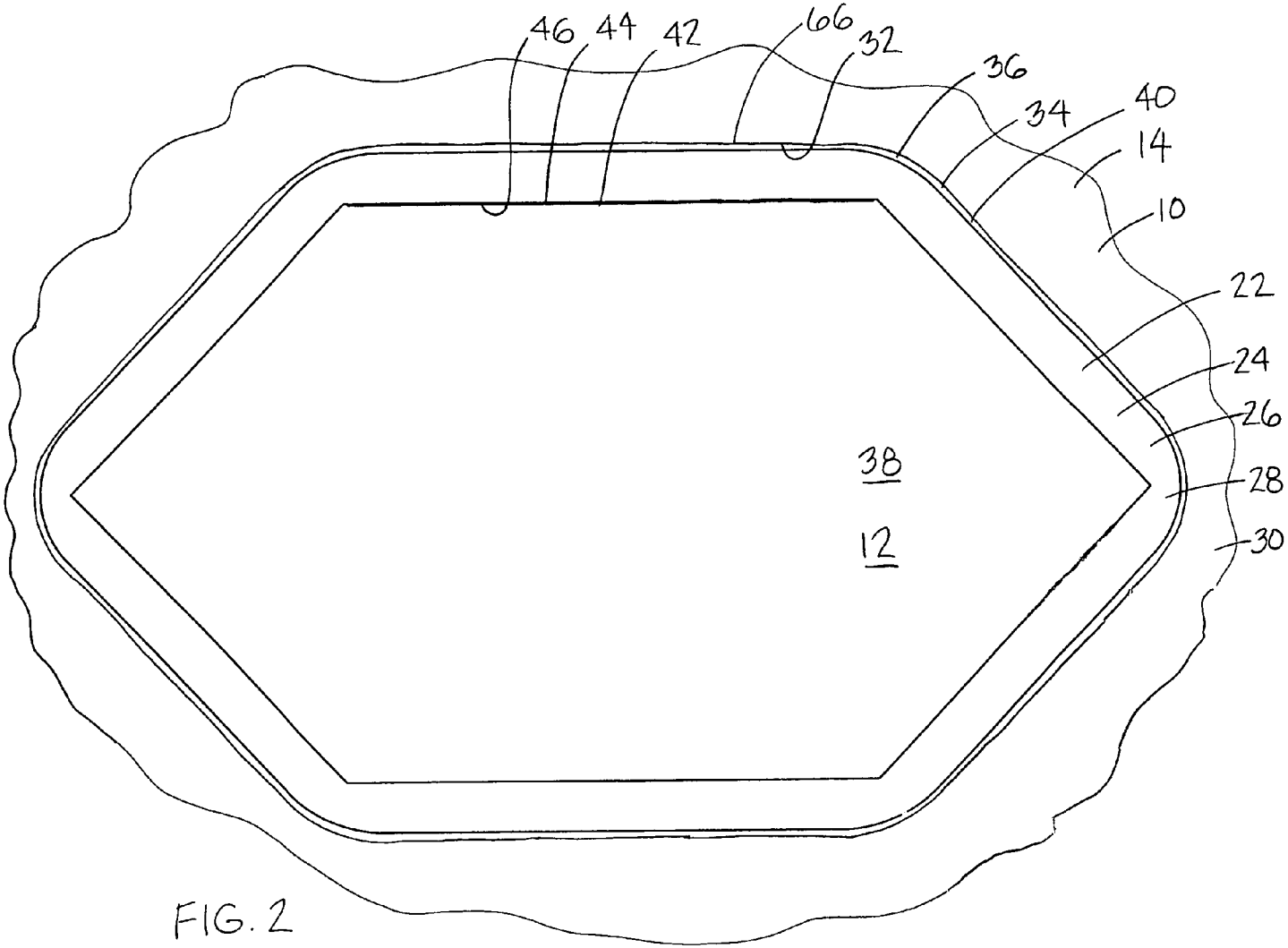
FIG. 2 is a top view of one embodiment of a closure structure secured by a coaming structure.

FIG. 2 is a top view of one embodiment of closure structure 12 secured by a coaming structure 22 to hull 14, wherein closure structure 12 has a generally oblong shape. In the embodiment shown, coaming structure 22 may include a base region 24 that may define a top surface 26, wherein top surface 26 may define a plane 28. Coaming structure 22 may be machined from a single block of material so as to reduce stress within the structure that may be caused by other manufacturing techniques. Exterior surface 18 of hull 14 may also define a plane 30, and in the embodiment shown, plane 30 of hull 14 may be substantially contiguous with plane 28 of coaming structure 22. In other words, in the embodiment shown, plane 28 and plane 30 may define the same, single plane or may be positioned within 0.25 inches of each other. Hull 14 may include an aperture 32 wherein base region 24 of coaming structure 22 may be secured within aperture 32, such as by a weld 34. Weld 34 may define a top surface 36 that may be positioned substantially in plane 28 and plane 30. In other embodiments, coaming structure 22 and aperture 32 may abut against one another and weld 34 may be positioned on an interior surface of hull 14 and coaming structure 22 so as to secure the coaming structure to the hull. Closure structure 12 may also define a top surface 38 that may be positioned substantially in planes 28 and 30 when closure structure 12 is secured on coaming structure 22. Weld 34 may fill a gap 40 between hull 14 and coaming structure 22 and may be sanded or otherwise smoothed after welding so that the weld defines a smooth outer surface in planes 28 and 30. Closure structure 12 may define a perimeter 42 that may substantially match a perimeter 44 of an inner aperture 46 of coaming structure 22 such that there is no appreciably visible gap between coaming structure 22 and closure structure 12. Accordingly, hull 14, weld 34, coaming structure 22 and closure structure 12 may define a substantially smooth, continuous exterior surface of marine vessel 10 having no substantial steps (vertical discontinuities) and no substantial gaps (horizontal discontinuities) such that marine vessel 10 may be substantially undetectable by radar systems.

Figure 3:
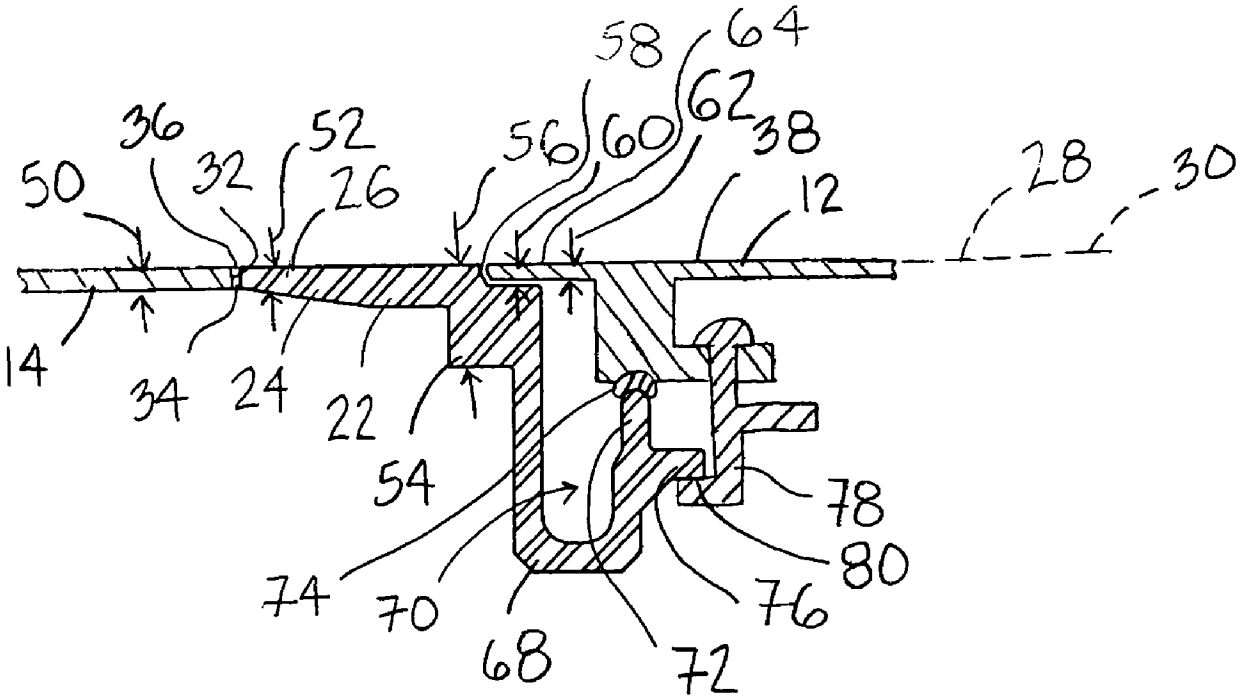
FIG. 3 is a side cross-sectional view of one embodiment of a coaming structure secured to a marine vessel hull and having a closure structure secured thereto.

FIG. 3 is a side cross-sectional view of one embodiment of coaming structure 22 secured to marine vessel hull 14 and having closure structure 12 secured thereto. Coaming structure 22 may include base region 24 which may include an edge region 26 secured to aperture 32 of hull 14 by weld 34. Hull 14 and edge region 26 of coaming structure 22 may each define a thickness 50 and 52, respectively, that may each be approximately one quarter of an inch thick. Base region 24 may be connected to a block region 54 that may define a thickness 56 that may be at least double the thickness of edge region 26. In the embodiment shown, block region 54 of coaming structure 22 may be approximately one inch thick. The thickness 56 of block region 54 of coaming structure 22 may provide structural strength to coaming structure 22 such that coaming structure 22, and a closure structure 12 supported thereon, may support the weight of a person without appreciably deforming. Moreover, the thickness 56 of coaming structure 22 may also function to replace a strength of hull 14 that may have been lost due to the material that has been removed from hull 14 to form opening 32.

Block region 54 may include a groove or a recess 58 that may define a depth 60 adapted to receive closure structure 12 therein such that top surface 38 of closure structure 12 may be positioned in planes 28 and 30 (which in the embodiment shown represent substantially the same plane) of coaming structure 22 and hull 14, respectively. In the embodiment shown, closure structure 12 may have a thickness 62 in an edge region 64 of approximately one quarter of an inch, and recess 58 may define a depth 60 of approximately one quarter of an inch.

Recess 58 of block region 54 of coaming structure 22 may receive edge region 64 of closure structure 12 directly thereon. Accordingly, in an embodiment wherein coaming structure 22 and closure structure 12 are each manufactured of an electrically conductive material, such as aluminum and/or electrically conductive glass, coaming structure 22 may provide a continuous electrical conductivity path between coaming structure 22 and closure structure 12. Moreover, this direct conductivity contact between recess 58 of coaming structure 22 and edge region 64 of closure structure 12 may extend substantially around a perimeter 42 (see FIG. 2) of closure structure 12. Similarly, in an embodiment wherein hull 14, coaming structure 22 and weld 34 are each manufactured of an electrically conductive material, such as aluminum and/or electrically conductive glass, coaming structure 22 may provide a continuous electrical conductivity path between coaming structure 22 and hull 14. Moreover, this direct conductivity contact between hull 14 and coaming structure 22 may extend substantially around a perimeter 66 (see FIG. 2) of aperture 32 of hull 14 due to weld 34. In the embodiment shown, therefore, hull 14, weld 34, coaming structure 22 and closure structure 12 may define a substantially continuous conductivity path through these structural components such that marine vessel 10 may be substantially undetectable by radar systems.

Figures 7, 10, 11, 13:
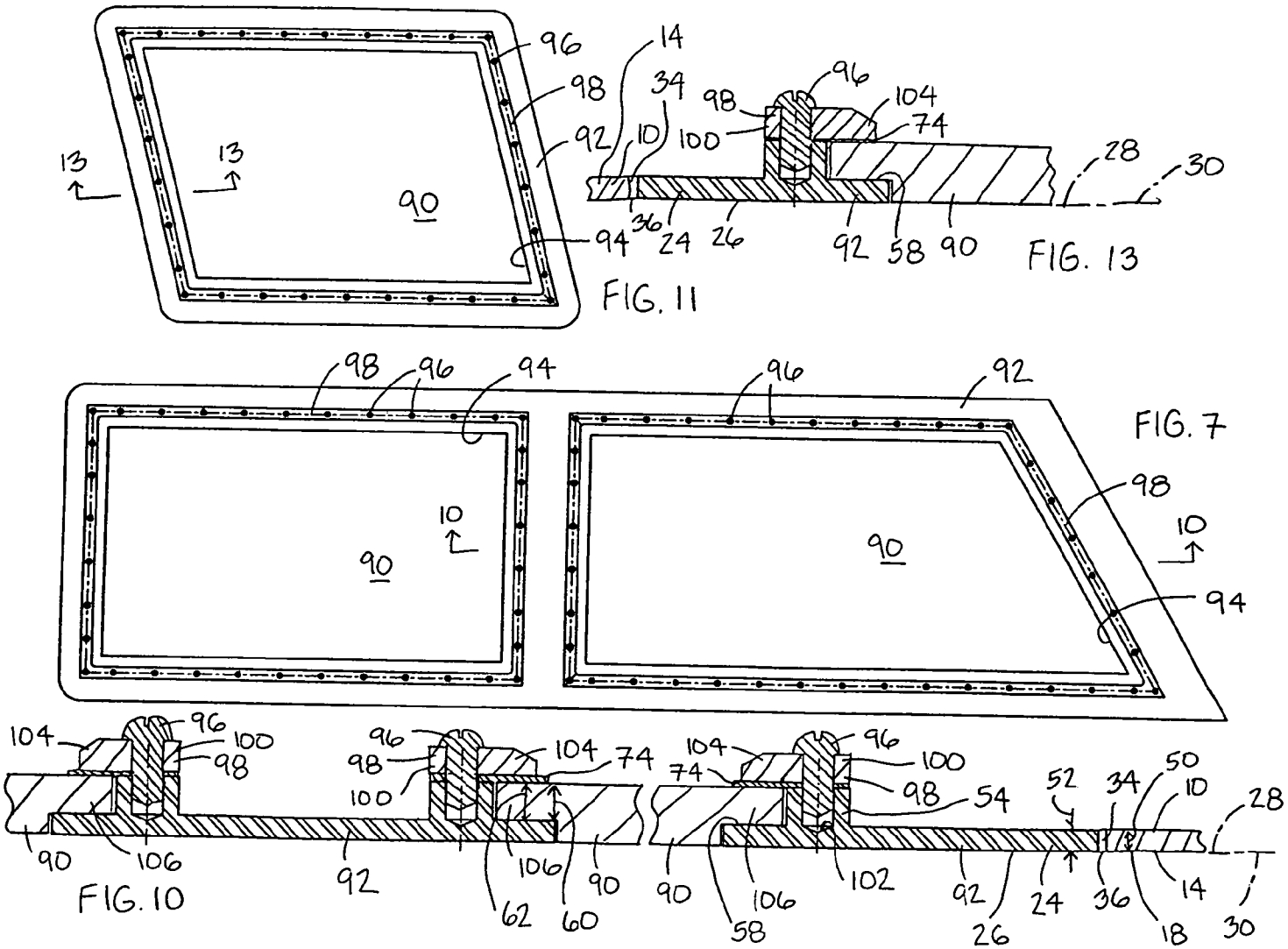
FIG. 7 is a bottom view of another embodiment of a closure structure secured by another embodiment of a coaming structure.
FIG. 10 is a side cross-sectional view taken along line 10—10 of FIG. 7.
FIG. 11 is a bottom view of another embodiment of a closure structure secured by a coaming structure.
FIG. 13 is a side cross-sectional view taken along line 13—13 of FIG. 11.

Coaming structure 22 may further include a flange 68 manufactured integral with block region 54 and edge region 26 (in other embodiments flange 68 may be a separate structural component attached thereto by a fastener, see FIG. 10). Flange 68 may be positioned adjacent recess 58 and may define a drainage region 70 and an upwardly extending lip 72 adapted for receiving a seal 74 thereon. Seal 74 may comprise an elastomeric material and may be adapted for defining a water-tight seal between closure structure 12 and coaming structure 22. Seal 74 may be secured to closure structure 12 or to flange 68 of coaming structure 22. In either case, seal 74 may be adapted for being positioned on lip 72 when closure structure 12 is in a closed position on coaming structure 22 so to as to define a water-tight seal between coaming structure 22 and closure structure 12. In another embodiment, structure 74 may comprise an isolator or a cushion used for creating a cushion between the glass cover and the aluminum coaming structure. In such an embodiment, a water tight seal may be created between closure structure 12 and coaming structure 22 by the frictional fit at recess 58. In such an embodiment, cushion 74 may be manufactured of ultra high molecular weight polyethylene (UHMWPE).

Flange 68 may further include an outwardly extending lip 76 adapted for receiving a securement mechanism 78 of closure structure 12 so as to secure closure structure 12 in a secured position on coaming structure 22. In the embodiment shown, securement mechanism 78 may comprise a manually pivotable lever that is captured by a lower surface 80 of lip 76. In other embodiments, other securement mechanisms, including automated securement mechanisms, may be utilized.

Figure 4:
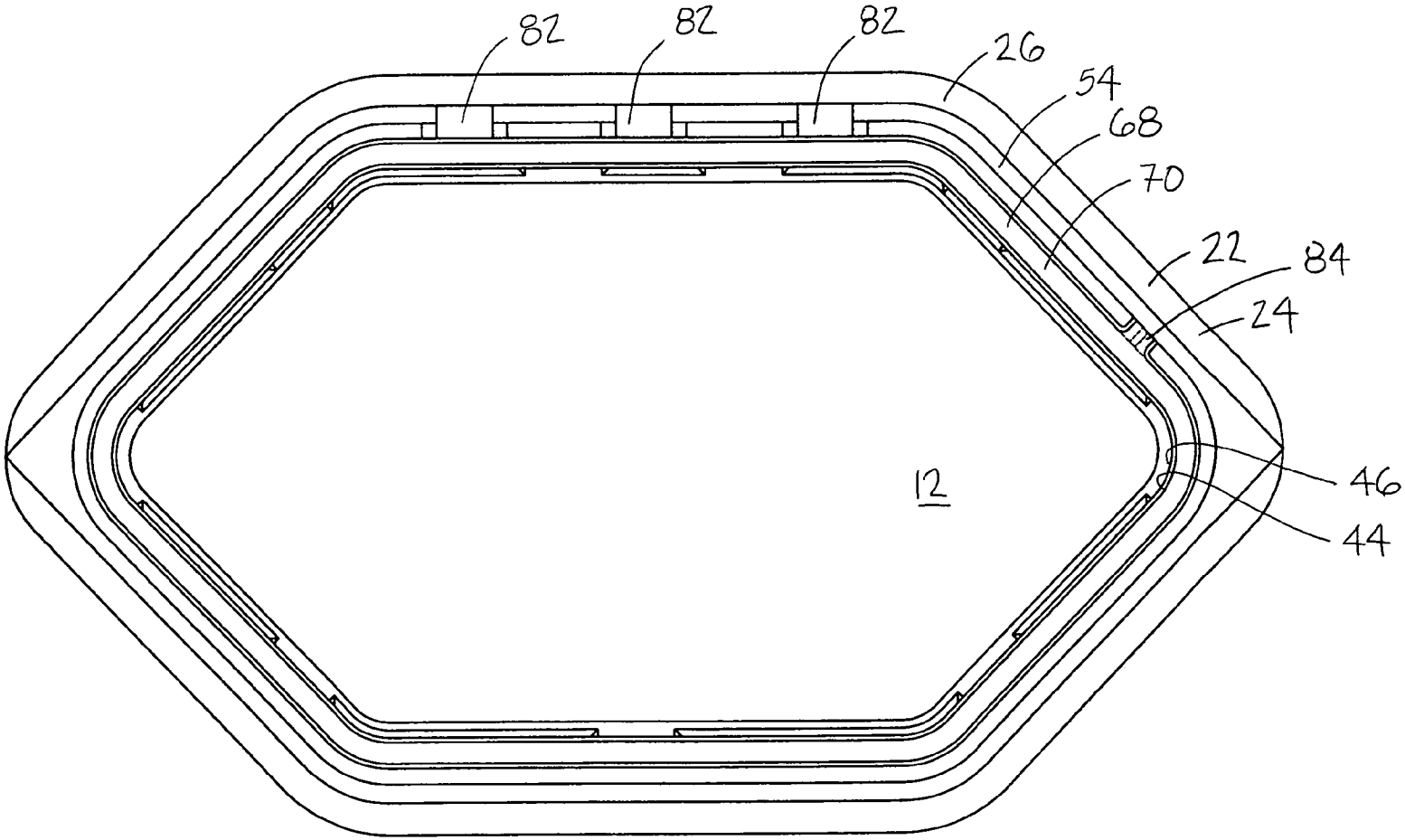
FIG. 4 is a bottom view of the closure structure of FIG. 2.

FIG. 4 is a bottom view of the closure structure 12 of FIG. 2. Coaming structure 22 may include hinges 82 that may be secured to closure structure 12 so that closure structure 12 may be pivotally moved with respect to coaming structure 12. In an embodiment including hinges 82, closure structure 12 may comprise a hatch for movement of crew members and/or cargo therethrough. Coaming structure 22 may further include a drainage output 84 that may be connected to drainage region 70, wherein drainage region 70 may extend substantially around perimeter 44 of aperture 46 of coaming structure 22.

Figure 5:
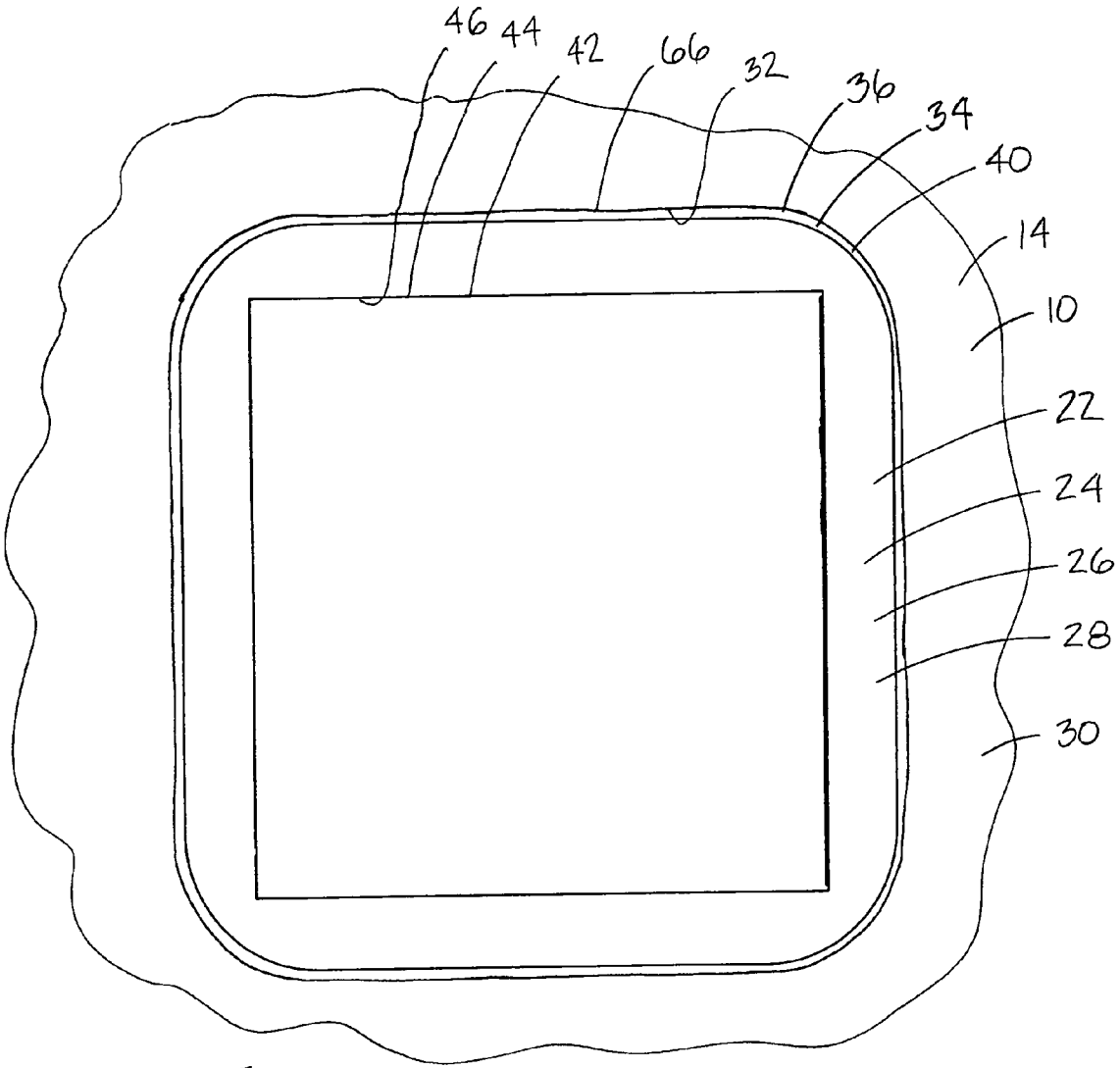
FIG. 5 is a top view of another embodiment of a closure structure.

FIG. 5 is a top view of another embodiment of a closure structure 12 wherein closure structure 12 has a generally square shape.

Figure 6:
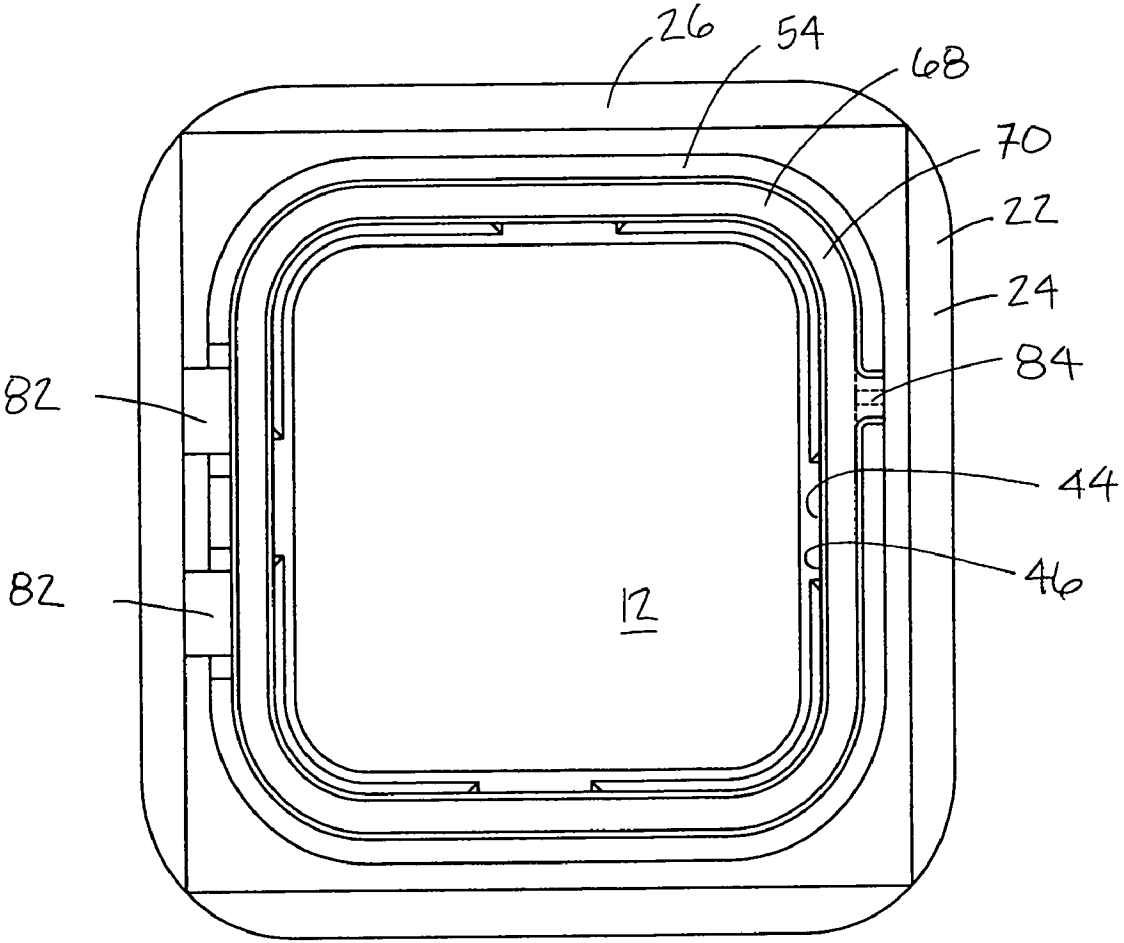
FIG. 6 is a bottom view of the closure structure of FIG. 5.

FIG. 6 is a bottom view of closure structure 12 of FIG. 5.

FIG. 7 is a bottom view of another embodiment of a closure structure 90 secured by another embodiment of a coaming structure 92. In this embodiment, closure structure 90 may comprise a window manufactured of an electrically conductive glass and may be positioned in control area 16 (see FIG. 1) of marine vessel 10 such that the view of FIG. 7 is looking outwardly from inside control area 16 (see FIG. 1). In this embodiment, closure structure 90 may comprise two windows positioned side by side and coaming structure 92 may comprise two apertures 94 for receiving the two closure structures 90. Closure structures 90 may each be secured to coaming structure 92 by a securement mechanism 96 extending through a flange 98 that may be shaped to substantially match the outer shape of closure structures 90. Securement mechanisms 96 may comprise any type of securement mechanism and, in the embodiment shown, may comprise a fastener such as threaded screws.

Figures 8, 9, 12:
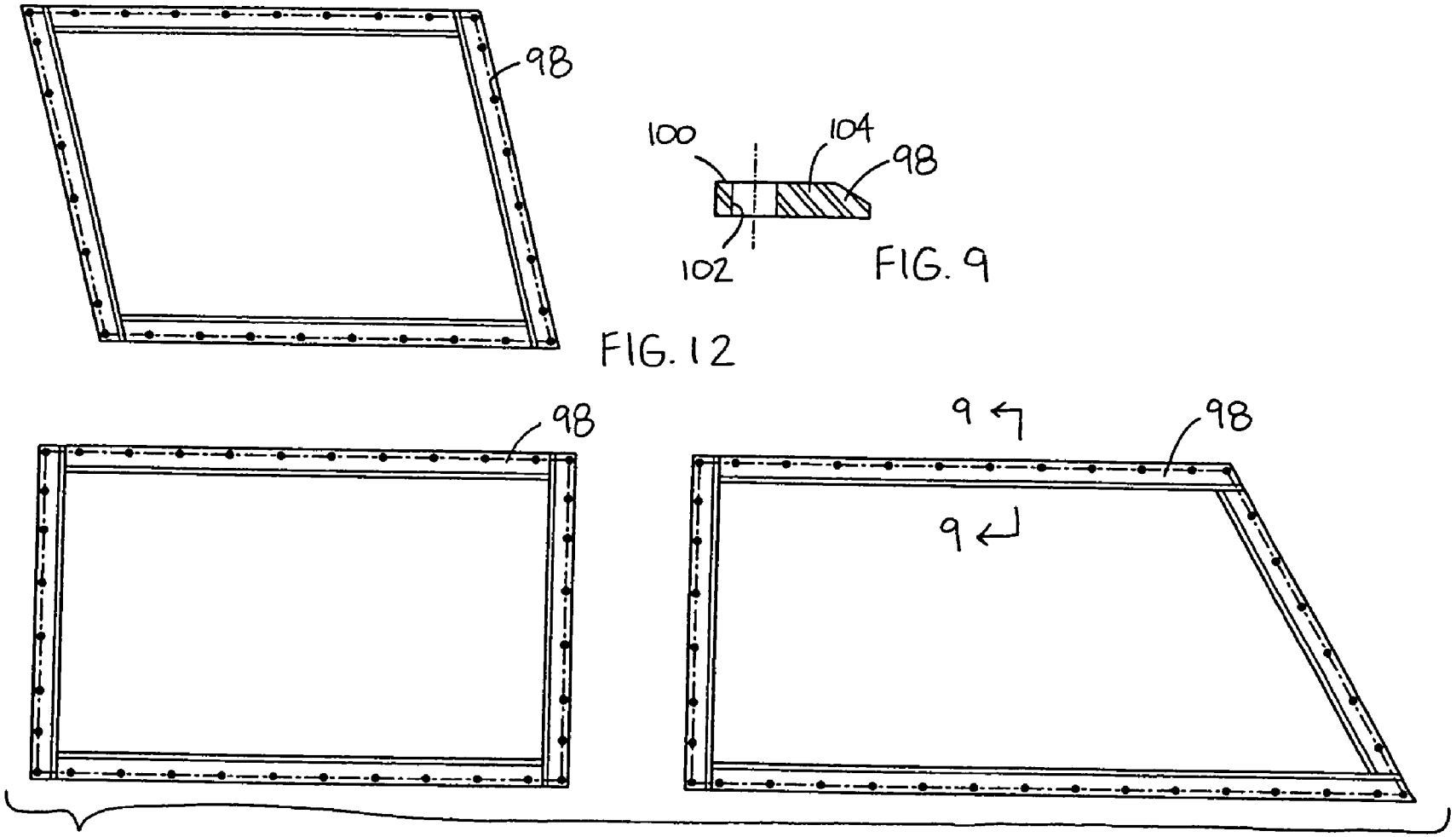
FIG. 8 is a bottom view of another embodiment of a coaming structure flange.
FIG. 9 is a side cross-sectional view along line 9—9 of FIG. 8.
FIG. 12 is a bottom view of another embodiment of a coaming structure flange.

FIG. 8 is a bottom view of coaming structure flanges 98 shaped to secure the closure structures 90 of FIG. 7.

FIG. 9 is a cross-sectional view along line 9—9 of FIG. 8. Flange 98 may include a first region 100 including apertures 102 therein for receiving fasteners 96 (see FIG. 7). Flange 98 may include a second region 104 adapted to extend over an edge region 106 of closure structure 90 (see FIG. 10) so as to secure closure structure 90 to coaming structure 92.

FIG. 10 is a side cross-sectional view taken along line 10—10 of FIG. 7 of coaming structure 92 with flange 98 and closure structure 90 secured thereto. Coaming structure 92 may include a block region 54 including a recess 58 adapted for receiving edge region 106 of closure structure 90. In the embodiment shown, recess 58 may be in direct contact with edge region 106 of closure structure 90 such that, in the embodiment wherein coaming structure 92 and closure structure 90 are both manufactured of an electrically conductive material, coaming structure 92 may define an electrical conductivity path between hull 14, through coaming structure 92 and to closure structure 90. In the embodiment shown, hull 14, coaming structure 92, and flange 98 may each be manufactured of a conductive material, such as aluminum, whereas closure structure 90 may be manufactured of a transparent and conductive material such as conductive glass. In the embodiment shown, therefore, hull 14, weld 34, coaming structure 92 and closure structure 90 may define a substantially continuous conductivity path through these structural components such that marine vessel 10 may be substantially undetectable by radar systems.

Still referring to FIG. 10, a seal 74 may be positioned between closure structure 90 and flange 98 so as to provide a water-tight seal between coaming structure 92 and closure structure 90. Coaming structure 92 may be secured to hull 14 at an edge region 26 of a base region 24 by a weld 34. Weld 34 may define a top or outer surface 36 that may be positioned substantially in the same plane 28 and/or 30 as top surface 26 of coaming structure 92 and exterior surface 18 of hull 14, respectively. In the embodiment shown, plane 28 of top surface 26 of coaming structure 92 and plane 30 of exterior surface 18 of hull 14 define substantially the same, single plane. Accordingly, hull 14, weld 34, coaming structure 92 and closure structure 90 may define a substantially smooth, continuous exterior surface of marine vessel 10 having no substantial steps (vertical discontinuities) and no substantial gaps (horizontal discontinuities) such that marine vessel 10 may be substantially undetectable by radar systems.

FIG. 11 is a bottom view of another embodiment of a closure structure 90 secured by a coaming structure 92. In this embodiment, closure structure 90 and coaming structure 92 may both comprise a substantially parallelogram shape.

FIG. 12 is a bottom view of another embodiment of a coaming structure flange 98 sized to secure the closure structure 90 of FIG. 11.

FIG. 13 is a cross-sectional view taken along line 13—13 of FIG. 11 of coaming structure 92 with flange 98 and closure structure 90 secured thereto.

Other variations and modifications of the concepts described herein may be utilized and fall within the scope of the claims below.

The invention claimed is:

1. A coaming structure for a marine vessel, comprising:

a base that includes a top surface that defines a plane, an edge region adapted for securement to a marine vessel hull, and a recess positioned opposite said base from said edge region, said recess adapted for receiving a closure structure therein; and a flange secured to said base, said flange adapted for sealing a closure structure thereto, wherein said base is welded into an aperture of a marine vessel hull such that said base becomes a component of said hull and such that said top surface of said base is positioned in a plane of an exterior surface of said hull.

2. A coaming structure according to claim 1 wherein said recess is adapted for defining a continuous electrical conductively path between said coaming structure and a closure structure received thereon.

3. A coaming structure according to claim 1 wherein said recess defines a depth adapted to position an exterior surface of a closure structure in said plane.

4. A coaming structure according to claim 1 wherein said flange is secured to said base at a block portion, said block portion defining a thickness greater than a thickness of said base and said flange.

5. A coaming structure according to claim 1 wherein said base is adapted for securement to a marine vessel hull such that an exterior surface of said hull is positioned in said plane.

6. A coaming structure according to claim 1 further comprising a seal positioned on said flange wherein said seal is adapted to provide a water-tight seal between said coaming structure and a closure structure received thereon.

7. A coaming structure according to claim 1 wherein said flange further includes a lip adapted for receiving a securement structure of a closure structure.

8. A coaming structure according to claim 1 wherein said flange further includes a drainage reservoir positioned adjacent said recess.

9. A coaming structure according to claim 1 wherein said base defines a length sufficient to inhibit heat induced stress in said flange when said base is welded to a marine vessel hull.

10. A coaming structure according to claim 1 wherein said coaming structure is machined from a single block of solid material.

11. A coaming structure according to claim 1 wherein said flange is adapted for sealing a closure structure thereto, wherein said closure structure is chosen from one of a hatch, and a window.

12. A coaming structure according to claim 1 wherein said coating structure is substantially undetectable by radar when secured to a hull.

13. A marine vessel, comprising:

a hull including an aperture therein and an exterior surface that defines a plane; and a coaming structure secured within said aperture of said hull, said coaming structure including a top surface that defines a plane contiguous with said plane of said hull, wherein said coaming structure is adapted for securing a closure structure thereon, wherein said hull has a thickness, wherein said coaming structure is secured to said hull in an edge region, and wherein said edge region of said coaming structure has a thickness substantially similar to said thickness of said hull.

14. A marine vessel according to claim 13 further comprising a closure structure, and wherein said coaming structure further includes a groove recessed below said plane of said coaming structure top surface, said groove defining a depth adapted to position a top surface of said closure structure in said plane of said coaming structure top surface.

15. A marine vessel according to claim 13 wherein said coaming structure is welded to said hull, and wherein said weld includes a top surface positioned in said plane of said coaming structure top surface such that said hull, said weld and said coaming structure define a smooth exterior surface.

16. A marine vessel according to claim 13 wherein said coaming structure further includes a block having a recess for receiving said closure structure therein, and wherein said block has a thickness at least double the thickness of said edge region.

17. A marine vessel according to claim 13 wherein said hull and said coaming structure are both manufactured of an electrically conductive material, and wherein said coaming structure is secured to said hull so as to define a continuous electrical conductivity path from said hull and through said coaming structure.

18. A marine vessel according to claim 14 wherein said closure structure and said coaming structure are both manufactured of an electrically conductive material, and wherein said closure structure is secured to said coaming structure so as to define a continuous electrical conductivity path front said coaming structure and through said closure structure.

19. A marine vessel according to claim 18 wherein said closure structure is manufactured of one of conductive glass and aluminum, and wherein said coaming structure and said hull are manufactured of aluminum.

20. A method of sealing an aperture in a marine vessel hull, comprising:

providing a hull including a aperture therein, said hull defining an exterior surface;

securing a securement structure to said hull and within said aperture such that an exterior surface of said securement structure is aligned substantially in a single plane with said exterior surface of said hull; and securing a closure structure to said securement structure, said securement structure positioning said closure structure such that an exterior surface of said closure structure is aligned substantially in said single plane with said exterior surface of said hulls, wherein said hull, said securement structure and said closure structure are each manufactured of a conductive material, and wherein said securement structure provides a continuous electrical conductivity path from said hull to said closure structure substantially along a perimeter of said securement structure.

21. A method according to claim 20 wherein said securement structure is welded to said hull within said aperture.

22. A method according to claim 20 wherein said securement structure includes a seal for providing a water-tight seal between said closure structure and said securement structure.

23. A marine vessel, comprising:

means for covering an aperture of a marine vessel hull; and means for securing said means for covering to said marine vessel hull, said means for securing defining a top surface positioned substantially in a plane with a top surface of said hull, and said means for securing positioning a top surface of said means for covering substantially in said plane with said top surface of said hull, wherein said means for securing is substantially undetectable by radar when secure to said hull.

24. A marine vessel according to claim 23 wherein said means for covering is chosen from one of a window and a hatch.

25. A marine vessel according to claim 23 wherein said means for securing provides a substantially continuous electrical conductivity path through said hull and through said means for covering.

26. A marine vessel according to claim 23 wherein said means for securing includes a flange having a seal thereon, wherein said seal defines a water-tight seal between said means for covering and said means for securing.

27. A marine vessel according to claim 23 further comprising a flange secured to said means for securing by a fastener, wherein said flange includes a seal that defines a water-tight seal between said means for covering and said means for securing.

* * * * *